United States Patent [19]

Morita et al.

[11] 4,369,714

[45] Jan. 25, 1983

[54] CABLE CAR DOCKING SWAY ARRESTER MECHANISM

[75] Inventors: Masaaki Morita, Yokosuka; Michio Yamaguchi, Yokohama; Hiroyuki Asano, Tokyo, all of Japan

[73] Assignee: Nissan Motor Co., Ltd., Yokohama, Japan

[21] Appl. No.: 209,027

[22] Filed: Nov. 21, 1980

[30] Foreign Application Priority Data

| | | | |
|---|---|---|---|
| Nov. 27, 1979 | [JP] | Japan | 54-164477[U] |
| Apr. 7, 1980 | [JP] | Japan | 55-45790[U] |
| Apr. 8, 1980 | [JP] | Japan | 55-46416[U] |
| Sep. 24, 1980 | [JP] | Japan | 55-135708[U] |
| Sep. 26, 1980 | [JP] | Japan | 55-137452[U] |

[51] Int. Cl.[3] ..... B61B 3/02; B61B 7/06; B61B 12/04

[52] U.S. Cl. ..... 104/250; 104/93; 104/172 S; 104/173 R; 105/150; 105/329 S

[58] Field of Search ..... 104/112, 173 R, 173 ST, 104/249, 250, 251, 93, 172 S; 105/150, 329 S, 329 SC

[56] References Cited

U.S. PATENT DOCUMENTS

| | | | |
|---|---|---|---|
| 1,122,080 | 12/1914 | Decker | 104/112 |
| 3,417,710 | 12/1968 | Kokes | 104/173 R |
| 3,461,813 | 8/1969 | McIlvaine | 104/173 R |
| 3,675,588 | 7/1972 | Gaynor | 104/173 ST |
| 3,742,864 | 7/1973 | Frech | 105/150 |
| 3,827,368 | 8/1974 | Garnier | 104/112 |
| 4,185,562 | 1/1980 | Hatori et al. | 104/112 X |
| 4,327,646 | 5/1982 | Nakata et al. | 104/89 |

FOREIGN PATENT DOCUMENTS

| | | | |
|---|---|---|---|
| 3003996 | 8/1980 | Fed. Rep. of Germany | 104/250 |
| 1273958 | 9/1961 | France | 104/173 R |
| 2050272 | 4/1971 | France | 104/173 R |
| 2447839 | 8/1980 | France | 104/173 R |
| 290578 | 6/1928 | United Kingdom | 104/173 R |
| 2041305 | 9/1980 | United Kingdom | 104/112 |

*Primary Examiner*—Robert B. Reeves
*Assistant Examiner*—Howard Beltran
*Attorney, Agent, or Firm*—Lane, Aitken, Kice & Kananen

[57] ABSTRACT

A cable car type vehicle arrester features a pair of trumpet bars which are interconnected by a link which either maintains the distance between the bars constant or reduces same upon one of the bars being deflected outboard of its home or rest position. This reduces the free swinging time of the vehicle between bars and increases the distance through which the bars subsequent to the initial deflection are deflectable by the vehicle. This accordingly increases the stroke of shock absorbers associated with the bars increasing the conversion of the kinetic energy of the vehicle. Casters can be provided to support the bars to allow longer lighter bars with less robust bearing and structural members. The casters can be run on a corrugated surface to cam the bars vertically further increasing the kinetic energy conversion and endow a self-centering action on the arrester. Extensions on the trumpet bars which are coextensive with guide rails on the station are simultaneously engageable with a roller or rollers on the vehicle for forcing the trumpet bars back to a centered or home position.

10 Claims, 15 Drawing Figures

CABLE CAR DOCKING SWAY ARRESTER MECHANISM

BACKGROUND OF THE INVENTION

1. Field of the Invention

The present invention relates generally to cable car type suspended vehicles and more particularly to a mechanism for rapidly arresting the swinging and/or pitching of the vehicle as it approaches a station for docking thereat.

2. Description of the Prior Art

In a known arrangement, it has been proposed to damp or arrest the swinging motion of a cable car type vehicle as it approaches a station for docking thereat, by using a pair of essentially straight bars which are each formed with curved portions at one end. These bars are arranged in a manner which resembles the cross section of a trumpet and are each individually mounted to the cable car station through a plurality of shock absorbers. This arrangement is intended to stablize the vehicle as it approaches the station and align it for safe collision-free docking. However, the above arrangement has suffered from a number of drawbacks. That is to say, as the vehicle approaches and enters the zone where the arrester projects from the end of the station, a roller or rollers provided on the lower side of the vehicle come into contact with a bar. The bar is displaced compressing one or more of the shock absorbers so that after some of the swinging motion has been damped the vehicle "bounces" back toward the second bar to impact thereagainst. However, as the first bar is displaced away from the second as a result of the first impact, the distance between the bars is increased, increasing the distance through which the vehicle must swing before impacting against the second bar. This of course increases the free swinging time between the bars (during which time almost no kinetic energy is converted) hence increasing the time required for any one oscillation of the vehicle to be damped. Further, as the first bar is mounted on shock absorbers which have been compressed by the initial impact, the vehicle is apt to reimpact on the first bar before the shock absorbers have re-elongated. This of course reduces the effectiveness of the absorber and increases the shock imparted to the vehicle. Hence it has been necessary to slow the vehicle undesirably just prior to docking to allow the required time for the swinging of the vehicle between the bars, which are displaced away from each other by each impact, and for the shock absorbers to appropriately re-elongate. A further drawback is encountered in that if a series of vehicles follow one and another in quick succession into the station, the "trumpet bars" as they will be referred to hereinafter, are apt to not be properly aligned with the guide rail or the like used to hold the vehicle in proper position when docked due to the prior compression of the shock absorbers. The shock absorbers also vary from unit to unit, especially after prolonged use which further enhances the possibility of improper alignment or increased time required for the two trumpet bars to re-assume their home positions.

SUMMARY OF THE INVENTION

The present invention features a pair of trumpet bars which are linked together so as to synchronously oscillate either at the same distance or at a reduced distance so that a roller or rollers on the bottom of the cable car vehicle remain in contact alternately with each of the trumpet bars for an increased amount of time thus increasing the time for which the actual shock absorption takes place and reducing the free swinging time between the bars. The interconnection further provides for a rapid return of the displaced bars toward their home position as the vehicle proceeds through the trumpet thus facilitating the safe docking of a number of closely spaced vehicles in quick succession. Further, the trumpet bars can be supported by casters which allows a reduction in thickness and strength of the trumpet bars per se, in turn enabling lighter and/or longer bars and an according reduction in inertia and the shock transmitted to the vehicle upon impact of the vehicle with a bar. The surface used to support the casters can advantageously be formed with a corrugated cross section to produce a camming action which acts to quickly return the casters and the associated trumpet bars to their home position in readiness for the next vehicle. The invention further features extended trumpet bars which are elongated past the fulcrum point or points thereof in the direction of the station, so that the vehicle on having passed by said fulcrum point or points and having entered the station and engaged a guide rail or rails which maintain the vehicle in a suitable position in the station, the trumpet bars are rapidly forced back into their home position due to the simultaneous engagement of the roller or rollers with both of the fixed guide rail or rails and the trumpet bar extensions.

BRIEF DESCRIPTION OF THE DRAWINGS

The features and advantages of the arrangement of the present invention will become more clearly appreciated from the following description taken in conjunction with the accompanying drawings in which like reference numerals denote corresponding elements, and in which.

DETAILED DESCRIPTION OF THE PREFERRED EMBODIMENTS

Figure 1:
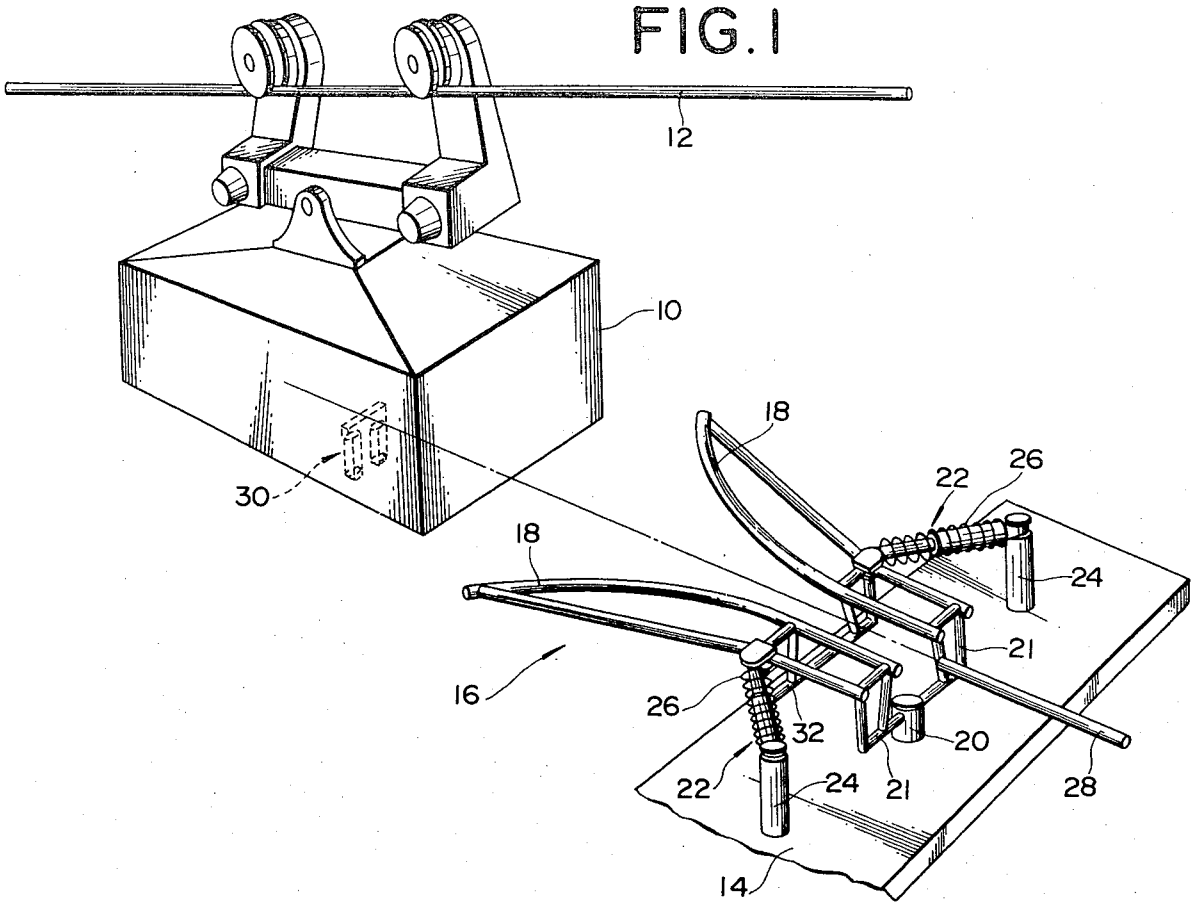
FIG. 1 is a perspective view showing a cable car vehicle approaching a docking arrester mechanism according to the first embodiment of the present invention.

Turning now to the figures and more specifically to FIG. 1, a first embodiment of the present invention is shown. In this figure the numeral 10 denotes a cable car type vehicle suspended via a suitable mechanism on a cable 12. A base plate 14 which is rigid with the station (not shown) supports an arrester mechanism 16. This mechanism consists of a pair of reinforced trumpet bars 18 which are pivotally mounted on a single pivot or bearing 20 by suitable "L" shaped brackets 21. Shock absorbers 22 operatively extend between uprights 24 and the trumpet bars 18. As shown each of the shock absorbers 22 is pivotally conected at each end thereof to a trumpet bar and an upright, respectively. Springs 26 disposed about the shock absorbers act to elongate same. Rigidly connected to the platform is a guide bar or rail 28. As shown in phantom the extrapolation of this guide rail extends to pass between a pair of rollers 30 mounted on the lower surface of the vehicle 10 which will engage on either side of the guide rail 28 upon the vehicle 10 having passed through the arrester mechanism and docked at the station. The rollers 30 also function to engage with the trumpet bars as the vehicle 10 approaches the station to facilitate the smooth egress of the vehicle between and along the trumpet bars. A link 32 rigidly interconnects the two trumpet bars and associated reinforcements to cause same to pivot synchronously together about the pivot 20. The link is "U" shaped so as to not hinder the passage of the rollers 30 and/or vehicle 10 between the trumpet bars.

In operation, as the vehicle approaches and enters the zone defined at the mouth of the trumpet bars, due to the swaying or swinging of the vehicle 10 on the cable 12, a roller 30 will impact on a trumpet bar deflecting it and compressing the associated shock absorber 22. The link 32 will draw the other of the trumpet bars in the same direction as the deflected one and inboard of its home position, thus maintaining the distance between the bars constant. Subsequently as the vehicle swings back toward the second of the trumpet bars the distance travelled by the vehicle 10 is only that normally defined between the two trumpet bars at that particular level of the arrangement. That is to say, the distance between the bars continuously decreases to a given value after the bars become parallel. However, upon the vehicle impacting with the second of the trumpet bars, it will be appreciated that one of the rollers 30 will remain in contact therewith for a relatively long period as the second bar must be deflected from inboard of its home position to a position outboard thereof. The shock absorber associated with the second bar is thus able to convert more of the kinetic energy of the vehicle 10 into different kinds of energy (viz., work and heat) than in the case of the shock absorber associated with the first trumpet bar as a result of the initial impact. Subsequent to the second impact the vehicle then swings back toward the first trumpet bar which has followed the second across its home position to a position inboard thereof. The vehicle upon reimpact with the first trumpet bar then forces this bar back toward and across the home position thereof to a position outboard of same. Hence upon each impact subsequent to the first, the shock absorbers associated with each of the trumpet bars are alternately elongated from their rest positions and then compressed hence increasing the length of the stroke which converts the kinetic energy of the vehicle. Moreover, as the vehicle progresses through the trumpet, the fact that the bars are interlinked induces a centering action which forces the bars progressively back toward their home positions in readiness for the next vehicle to enter the trumpet which is accordingly properly aligned.

Figure 2:
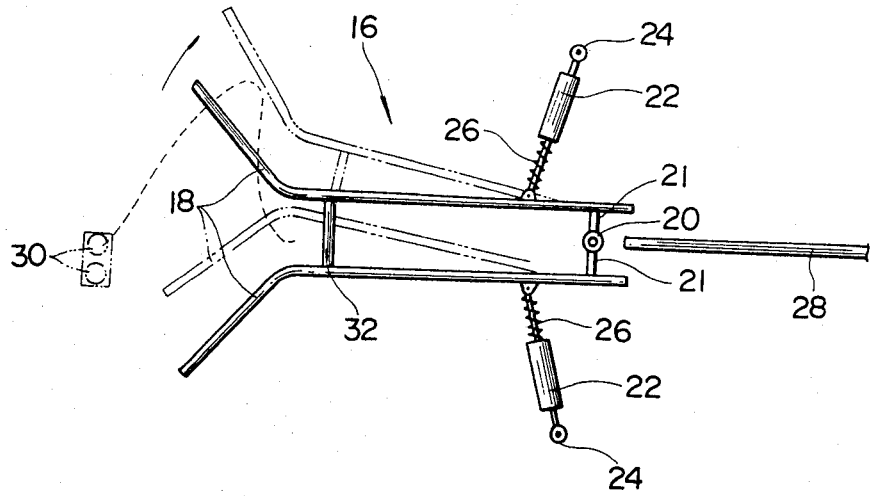
FIG. 2 is a plan view of a second embodiment of the present invention.
Figure 3:
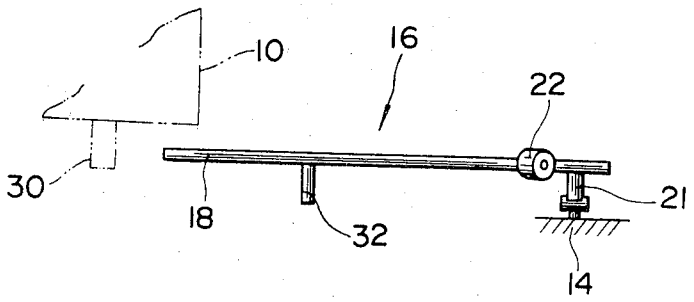
FIG. 3 is an elevation of the arrangement shown in FIG. 2.

FIGS. 2 and 3 show a second embodiment of the present invention. This arrangement is adapted for lighter vehicles than the first and accordingly is not provided with the reinforced trumpet structure of the first embodiment. The operation and function of this embodiment is identical with that of the first and is deemed to not require a detailed explanation. These figures indicate in phantom the trace of the rollers of the vehicle and the position outboard of the home position assumed by the first trumpet bar upon initial impact and the inboard position assumed by the second bar due to the interlinking of the two bars. Due to the lighter nature of the vehicle the trumpet mouth can be quickly reduced so that the bars become parallel some distance ahead of the fulcrum point defined at the pivot or bearing 20.

Figures 4, 5:
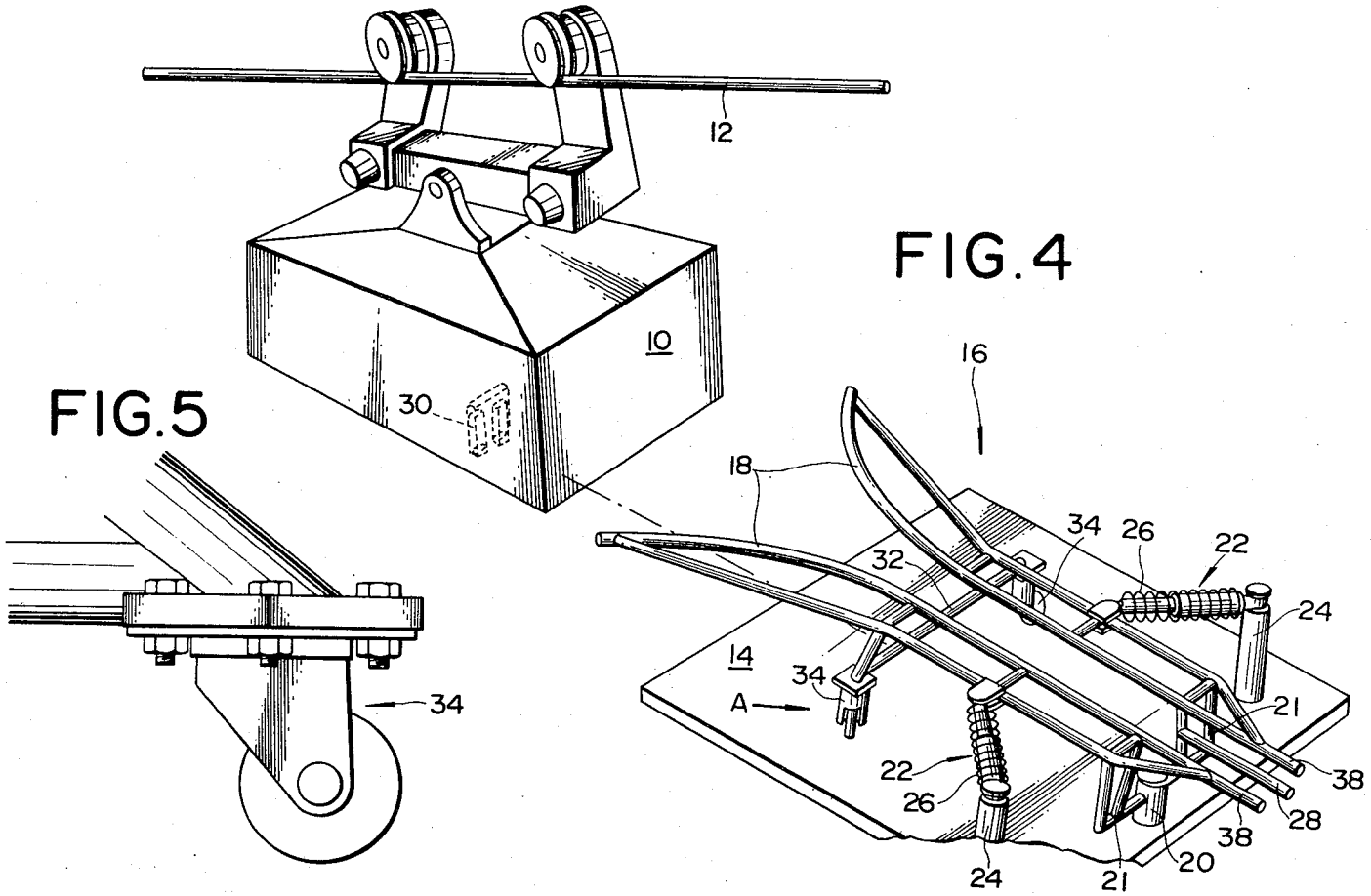
FIG. 4 is a perspective view similar to FIG. 1 showing a third embodiment of the present invention.
FIG. 5 is an elevational view of one of the casters used in the arrangement shown in FIG. 4 as seen along the arrow A in FIG. 4.

FIG. 4 shows a third embodiment of the present invention which is similar to that of FIG. 1 but which differs therefrom in the provision of casters 34 on the link 32 which roll on the base plate 14 and support the trumpet bars 18. The provision of the casters allows the trumpet bar structure and the bearing or pivot 20 (which otherwise bears the whole weight of the trumpet bars) to be reduced in strength and thickness and afford a notable reduction in weight of the moving components. This in turn reduces the inertia of the mechanism and accordingly reduces the shock received by the vehicle upon impact on the bars. It further allows the trumpet bars to be increased in length without requiring extremely robust bearings and structural members and allows the trumpet to extend well beyond the end of the station and base plate 14.

To assist the centering action inherent to the interlinked trumpet bar structure, the bars are extended slightly past the level of the bearing 20 for a distance to overlap the guide rail 28. With this overlap or coextensive arrangement, as the rollers 30 pass by the bearing 20 and pass on either side of the guide rail 28, the rollers are for a short distance in contact with both of the guide rail 28 and the extensions 38 of the trumpet bars. The resulting reaction rapidly forces the extensions 38 to become essentially parallel with the guide rail hence assuring that the trumpet is focussed or properly aligned for receiving the next vehicle. FIG. 5 shows a caster 34 suitable for use in the instant embodiment.

Figure 6:
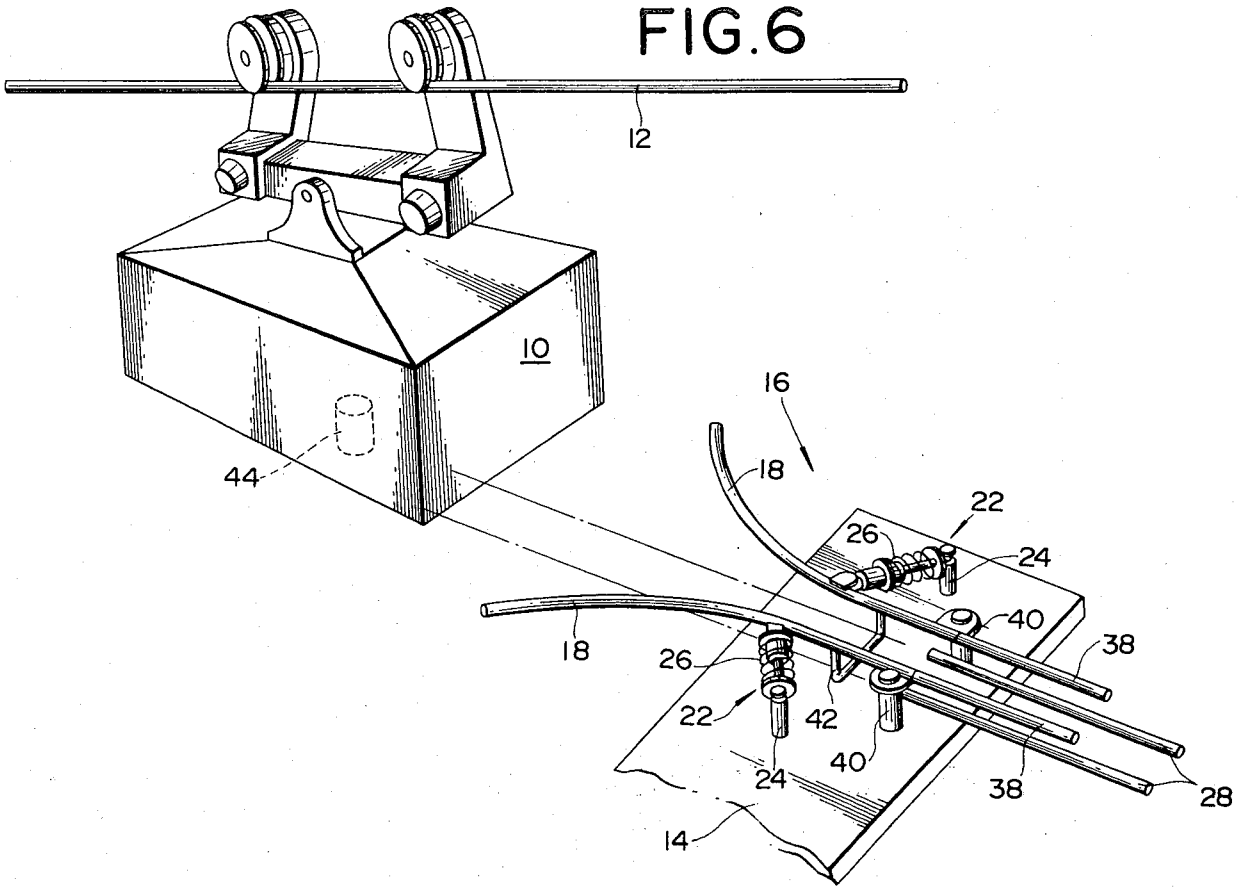
FIG. 6 is a perspective view of a fourth embodiment of the present invention.
Figure 7:
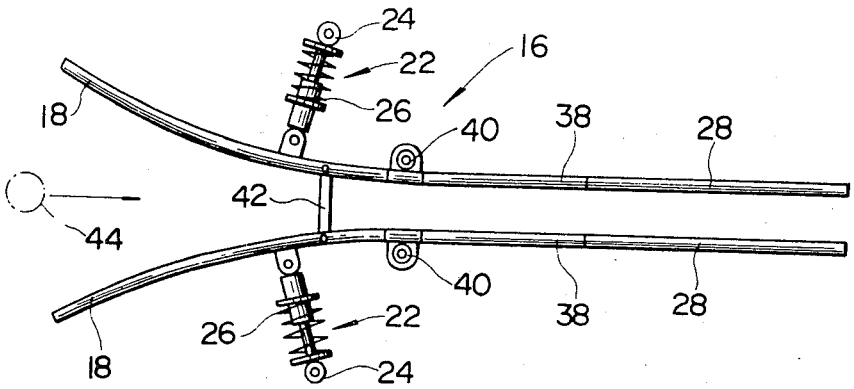
FIGS. 7 and 8 are plan and elevational views of the embodiment shown in FIG. 6.
Figure 8:
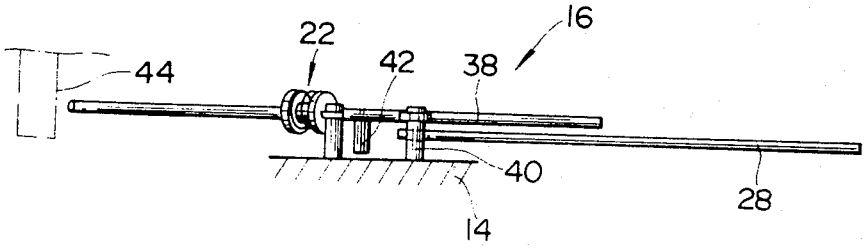

FIGS. 6, 7 and 8 show a fourth embodiment of the present invention. This arrangement like the second embodiment is suited, by way of example, for use with lighter non-passenger type vehicles such as used in factory transportation systems or the like. This embodiment is very similar to the second and differs in the use of trumpet bars 18 which are individually pivotted on pivots or bearings 40, a "U" shaped pivotal linkage 42 which is pivotally connected at each end thereof to a trumpet bar 18, and a pair of parallel guide rails 28. The guide rails extend a little past the level of the pivots 40 and can be advantageously connected to same via welding or the like to ensure that when the trumpet bars are in the rest position the extensions 38 thereof extend parallel and coextensively with the guide rails 28. With this arrangement a single roller 44 can be used provided that the clearance between the guide bars 28 (and the trumpet bar extensions 38) is slightly greater than the diameter of the roller 44.

Figure 9:
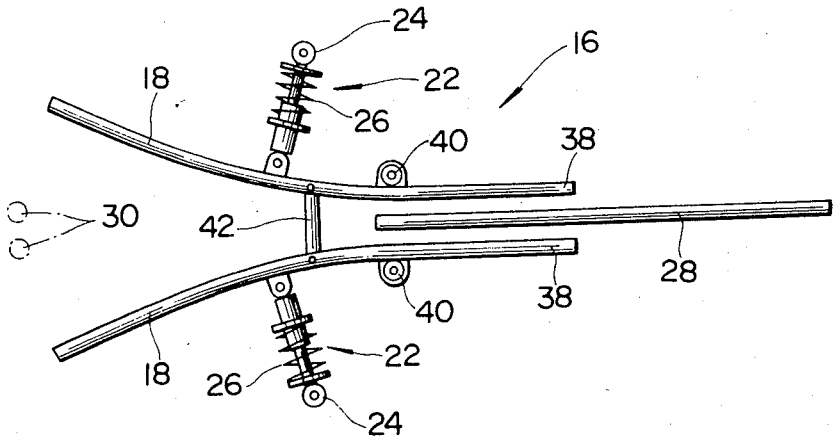
FIGS. 9 and 10 are plan and elevational views of a fifth embodiment of the present invention.
Figure 10:
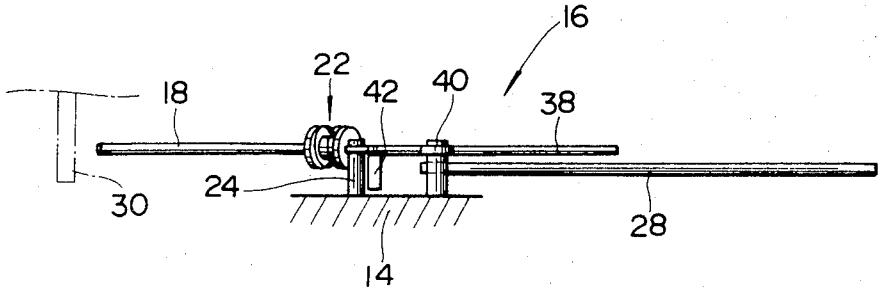

FIGS. 9 and 10 show a fifth embodiment of the present invention which is virtually the same as the previously described one but which differs in the use of single guide bar 28 and a pair of rollers 30 on the vehicle.

Figure 11:
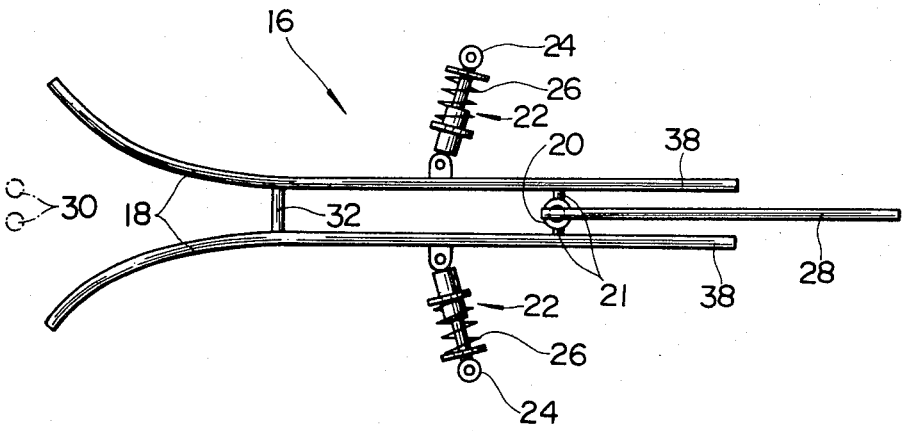
FIGS. 11 and 12 are plan and elevational views of a sixth embodiment of the present invention.
Figure 12:
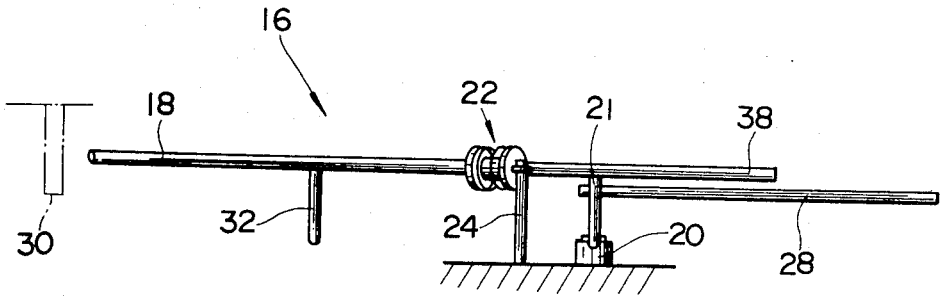

FIGS. 11 and 12 show a sixth embodiment of the invention. This embodiment features a rigid connection between the trumpet bars and a single pivot or bearing 20 in combination with the extensions 38 on the trumpet bars. With this arrangement the rigid interconnection between the trumpet bars maintains the distance therebetween constant while the extensions provide for a rapid centering action upon the vehicle docking at the station. A pair of guide rollers 30 are disposed on the vehicle 10 in this case which roll on either side of the single guide bar 28.

Figure 13:
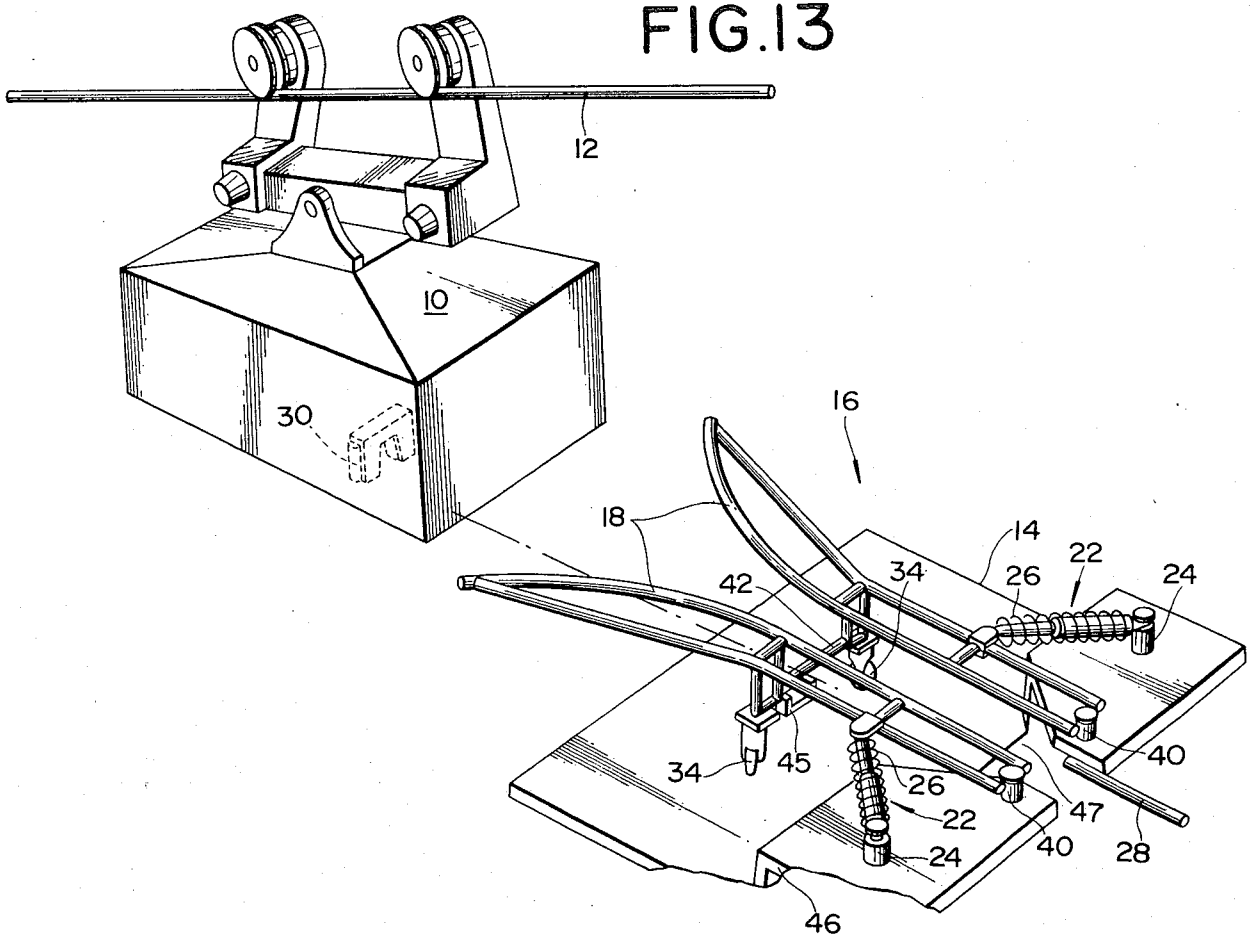
FIG. 13 is a perspective view similar to FIG. 1 showing a seventh embodiment of the present invention.

FIG. 13 shows a seventh embodiment of the invention. This embodiment is characterized by a combination of casters 34 which support the trumpet bars which are individually pivotted on pivots 40 and interconnected by a pivotal "U" shaped connection or linkage 42. The pivotal linkage 42 in this case induces a reduction in the distance between the trumpet bars upon a vehicle 10 impacting on a bar and displacing same to a position outboard of its home or rest position. To better understand this distance reduction, assume that the pivotal linkage is normal to the trumpet bars when the trumpet bar arrangement is in the home position, so that as the bars are moved from their home position, the angle between the linkage and the bars changes (in one case becoming acute and in the other oblique). Viz., in the home or rest position of the trumpet bars the four pivot points (viz., those defined at each end of the pivotal linkage 42 and at the individual bearings 40) define a rectangle. However upon deflection of the bars the four points then define a parallelogram wherein the distances between the respective opposed sides is reduced as compared with the rectangular state.

It will be appreciated that the deflection of the first trumpet bar by the initial impact of the vehicle thereon will reduce the distance between the two bars and both reduce the free swinging time of the vehicle 10 between the bars and increase the contact time with the second bar upon the second impact. The same phenomenon will occur for the subsequent impacts. An increased amount of conversion of kinetic energy is thus possible per swing of the vehicle thus increasing the rate of stablization of same. The reduced time required for stablization also permits the vehicle to approach the station at an increased speed hence facilitating a number of vehicles to one by one rapidly approach and dock at the station.

It should be noted that the same distance reduction phenomenon also occurs in the embodiments of FIGS. 6 to 8.

The embodiment of FIG. 13 is further characterized by the provision of a stopper 45 on a step 46 of the base plate 14 for limiting the movement of the casters 34, and a cutout 47 in the base plate which of course reduces the weight of the plate and provides for entry of the vehicle.

Figure 14:
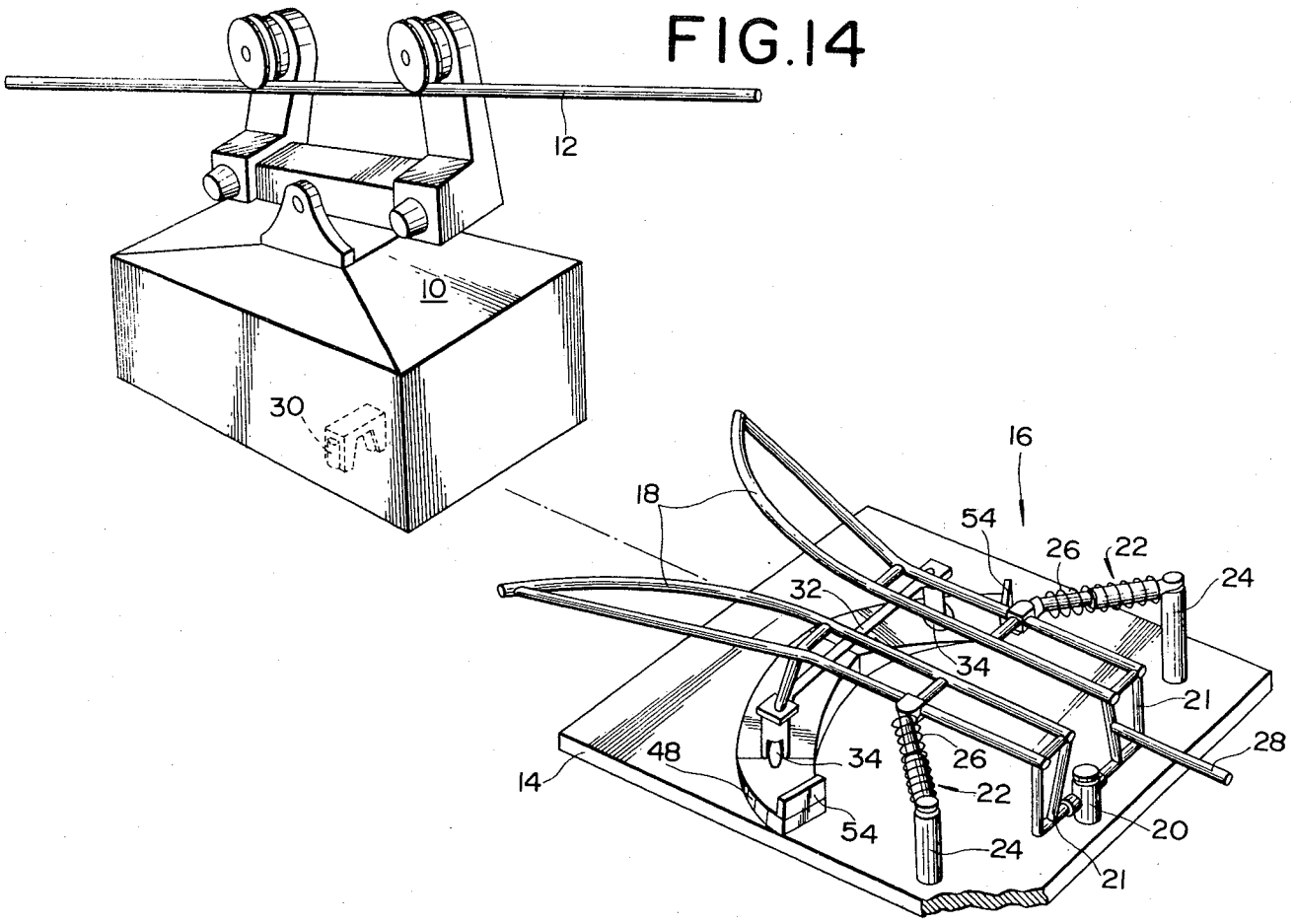
FIG. 14 is a perspective view similar to the preceeding figure showing an eighth embodiment of the present invention.
Figure 15:
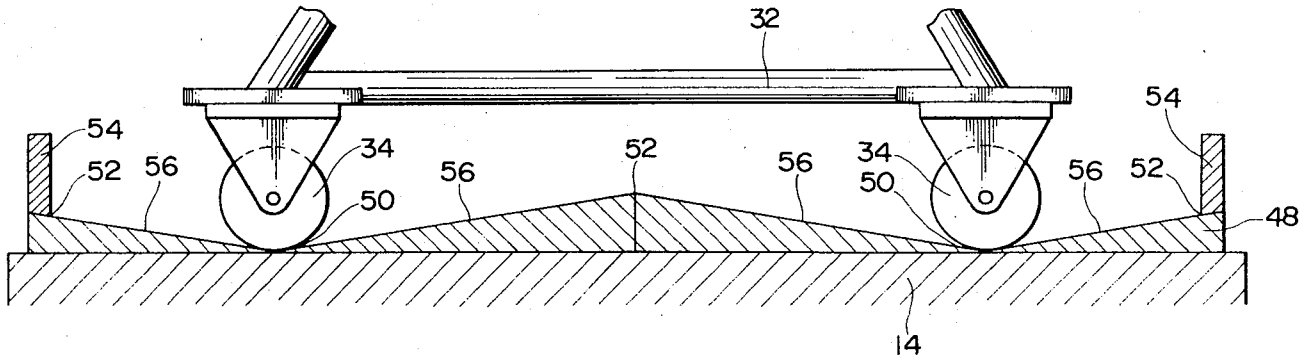
FIG. 15 is a cross sectional view of the surface on which the casters of the arrangement of FIG. 14 run, which surface defines a cam for urging the casters and associated trumpet bars back to their home positions.

FIG. 14 shows an eighth embodiment of the present invention. This embodiment features a single bearing or pivot 20, a rigid interconnection between the trumpet bars and casters which roll on a member 48 secured to the base plate 14. This member is arranged to have a "corrugated" cross section as shown in FIG. 15. This so called "corrugated" surface is arranged to have two troughs 50 which separate three peaks 52. At each end of the member 48 stoppers 54 are provided to limit the rolling of the casters. With this surface, as the vehicle impacts on a trumpet bar and the bar is accordingly displaced, the casters will be driven to roll up the slopes 56 leading from the troughs to the peaks. This of course lifts the trumpet bars vertically. To accomodate this action the single bearing or pivot 20 used in this instance is arranged to provide a "universal" action by allowing both the vertical as well as the horizontal pivoting of the trumpet bars thereabout.

With this embodiment, since additional work is required to be done lifting the trumpet bars vertically against the force of gravity (achieved the camming action of the member 46 and casters rolling thereon) some of the kinetic energy of the vehicle is used to perform the lifting, accordingly adding to the conversion of kinetic energy by the shock absorbers 22. Further, the weight of the trumpet bars after being lifted is utilized to force the casters to roll back into the troughs and assume their home position. This of course endows a self-centering ability on the arrester arrangement which adds to the inherent centering action produced by the vehicle passing through the trumpet.

The provision of the member 48 also allows for a reduction in the spring force of the shock absorbers in that the force damping the swinging of the vehicle 10 is composed of the spring force of the shock absorbers and the horizontal force component of the weight of the trumpet bars which forces same down the slopes 56 interconnecting the peaks and troughs (52,50) Thus as the spring force of the shock absorbers increases proportionally with the degree of deflection of the trumpet bars and the horizontal force component remains constant and dependent only on the weight of the trumpet bar arrangement and the angle of the slopes, the spring force can be reduced without a reduction in the total of force which returns the trumpet bars back toward their home positions. Hence the impact on the vehicle through the use of "softer" shock absorbers is reduced.

In all of the forgoing embodiments it is possible to replace the two shock absorbers 22 with a single double acting type.

Thus in summary, the present invention features a simple interlinked trumpet bar arrester arrangement whereby with the minimum of parts and complexity, increased amounts of kinetic energy can be converted per swing of a vehicle entering the arrester mechanism via either maintaining the distance between the bars constant or decreasing the distance therebetween upon one of the bars being displaced outboard of its home position via the impact of a swinging vehicle thereon. The invention also features a centering action which rapidly re-aligns the trumpet for receipt of a subsequent vehicle.

What is claimed is:

1. A vehicular system comprising:

a cable car suspended on a cable extending from a cable car station;

an arrester mechanism for damping the swinging motion of said cable car as it approaches and enters said station, said arrester mechanism being disposed at one end of said station and arranged to extend beyond said end of said station and which includes:

first and second arrester trumpet bars pivotally mounted at one end to said station, said trumpet bars flaring outwardly to define an opening therebetween;

a damper device interconnecting one of said trumpet bars and said station, said damper device including means for absorbing kinetic energy;

contact means on said cable car for entering the space defined between said trumpet bars and for alternatively contacting the inboard surfaces of said trumpet bars as said cable car approaches said station; and linkage means interconnecting said trumpet bars for causing said trumpet bars to move together so that upon impact of said contact means on said first trumpet bar and displacement thereof from a home position, said second trumpet bar will be displaced to increase the distance through which it may be subsequently displaced and the amount of kinetic energy of the cable car which is absorbed by said subsequent displacement, said damper device returning said first trumpet bar to said home position.

2. A vehicular system as claimed in claim 1, wherein said trumpet bars are pivotally mounted on the same pivot.

3. A vehicular system as claimed in claim 2, wherein said linkage means takes the form of a link rigidly interconnecting said trumpet bars.

4. A vehicular system as claimed in claim 1, wherein each of said trumpet bars is mounted on an individual pivot.

5. A vehicular system as claimed in claim 4, wherein said linkage means takes the form of a link which is pivotally connected at each end to a trumpet bar.

6. A vehicular system as claimed in claim 1, wherein said linkage means is provided with casters which roll on a surface rigid with said station.

7. A vehicular system as claimed in claim 6, wherein said trumpet bars are pivotal both horizontally and vertically about the pivot on which they are pivotally mounted.

8. A vehicular system as claimed in claim 7, wherein said surface is formed with a corrugated cross section wherein said casters rest in the troughs of the corrugations when said trumpet bars are in their home position, said corrugations being sufficiently wide to ensure that a caster will not pass over a peak of a corrugation even when said trumpet bars are maximumly deflected from their home positions.

9. A vehicular system as claimed in claim 1, wherein said contact means comprises a roller on said cable car which contacts said trumpet bars, and further comprises guide rail means fixedly connected to said station which extends from said station between said trumpet bars for engaging said roller upon said cable car having passed a predetermined distance through said trumpet bars.

10. A vehicular system as claimed in claim 9 further comprising an extension formed on each of said trumpet bars, said extensions extending in a parallel coextensive relationship with said guide rail means when said trumpet bars assume their home position so that said roller can, for a predetermined amount of travel, simultaneously engage said extensions and said guide rail means.

* * * * *